US009339927B2

(12) United States Patent
Xu et al.

(10) Patent No.: US 9,339,927 B2
(45) Date of Patent: May 17, 2016

(54) ACCESSORY CLAMPING MECHANISM AND POWER TOOL HAVING THE SAME

(71) Applicant: Chervon (HK) Limited, Wanchai (HK)

(72) Inventors: Guosheng Xu, Nanjing (CN); Georgi Severinets, Nanjing (CN); Hongtao Zhou, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 156 days.

(21) Appl. No.: 13/962,447

(22) Filed: Aug. 8, 2013

(65) Prior Publication Data

US 2014/0183828 A1 Jul. 3, 2014

(30) Foreign Application Priority Data

Dec. 29, 2012 (CN) ..... 2012 1 0590070
Dec. 29, 2012 (CN) ..... 2012 1 0590108

(51) Int. Cl.

| | |
|---|---|
| ***B27B 19/00*** | (2006.01) |
| ***B25F 5/00*** | (2006.01) |
| ***B27B 5/30*** | (2006.01) |
| ***B27B 5/32*** | (2006.01) |

(52) U.S. Cl.

CPC ... *B25F 5/00* (2013.01); *B27B 5/30* (2013.01); *B27B 5/32* (2013.01); *B27B 19/006* (2013.01); *Y10T 279/33* (2015.01)

(58) Field of Classification Search

CPC ..... B25F 5/00; B27B 5/32; B27B 19/006; B27B 5/30; Y10T 279/33
USPC ..... 83/315; 74/570.2
See application file for complete search history.

(56) References Cited

U.S. PATENT DOCUMENTS 2,279,211 A * 4/1942 Thomas ..... 83/185
2,885,212 A * 5/1959 Garrison ..... B23B 31/025 279/106
4,298,074 A * 11/1981 Mattchen ..... A61B 17/1624 173/129
4,989,374 A * 2/1991 Rudolf ..... B24B 23/022 451/342
5,092,869 A * 3/1992 Waldron ..... A61B 17/14 606/82
5,158,331 A * 10/1992 Wesselski ..... F16B 2/185 294/89
5,165,204 A * 11/1992 Luedeke ..... B24B 21/002 269/58
5,601,483 A * 2/1997 Rudolf ..... B24B 23/022 451/342
6,569,001 B2 * 5/2003 Rudolf ..... B24B 45/006 451/344
6,966,730 B1 * 11/2005 Miyanaga ..... B23B 31/1071 279/155
7,013,987 B2 * 3/2006 Nock ..... B23D 47/12 173/132
7,438,634 B2 * 10/2008 Habele ..... B24B 45/006 451/353

(Continued)

*Primary Examiner* — Sean Michalski
(74) *Attorney, Agent, or Firm* — Greenberg Traurig, LLP

(57) ABSTRACT

An accessory clamping mechanism for clamping an accessory to a working mandrel of a power tool wherein the working mandrel has a mandrel flange and a first longitudinal axis. The accessory clamping mechanism includes: at least one clamping member; a thrust member for supporting the clamping member; an elastic member by which the thrust member is biased towards a clamped position; a driving assembly for forcing the thrust member and the clamping member to move along the first longitudinal axis, the driving assembly comprising a driving member moved between a first position in which the accessory is in the clamped position and a second position in which the accessory is in a released position, the thrust member and the clamping member being driven by the driving member to move along the first longitudinal axis; and a motion converting member for driving the clamping member to move in a direction different from the first longitudinal axis.

9 Claims, 8 Drawing Sheets

(56) References Cited

U.S. PATENT DOCUMENTS 7,610,968 B1 * 11/2009 Honsa ..... B25F 5/006 173/162.1
7,856,724 B2 * 12/2010 Hartmann ..... B23Q 11/0092 125/13.01
7,997,586 B2 * 8/2011 Ziegler ..... B24B 23/04 279/7
8,215,649 B2 * 7/2012 Mack ..... B23B 31/123 279/125
8,317,574 B2 * 11/2012 Blickle ..... B24B 23/02 294/94
9,067,293 B2 * 6/2015 Bernardi ..... B24B 23/022
2002/0035882 A1 * 3/2002 Hartmann ..... B27B 5/32 74/107
2002/0038124 A1 * 3/2002 Lee ..... A61F 15/02 606/105.5
2003/0190877 A1 * 10/2003 Gallagher ..... B24B 23/02 451/344
2009/0023371 A1 * 1/2009 Blickle ..... B24B 45/006 451/359
2010/0197208 A1 * 8/2010 Blickle ..... B24B 23/02 451/342
2012/0074657 A1 * 3/2012 Zhou ..... B23B 31/4073 279/128
2014/0110908 A1 * 4/2014 Fankhauser et al. ..... 279/141
2014/0144655 A1 * 5/2014 Fuchs ..... 173/46
2014/0144662 A1 * 5/2014 Zhou ..... 173/213
2014/0182873 A1 * 7/2014 Fankhauser et al. ..... 173/213
2015/0042052 A1 * 2/2015 Furusawa et al. ..... 279/141
2015/0047866 A1 * 2/2015 Sakai et al. ..... 173/179

* cited by examiner

ACCESSORY CLAMPING MECHANISM AND POWER TOOL HAVING THE SAME

RELATED APPLICATION INFORMATION

This application claims the benefit of CN 201210590070.8, filed on Dec. 29, 2012, and CN 201210590108.1, filed on Dec. 29, 2012, the disclosures of which are incorporated herein by reference in their entirety.

FIELD

The subject disclosure relates to a clamping mechanism, and more particularly to a clamping mechanism for releasably fixing an accessory to a working mandrel. The subject disclosure further relates to a power tool having the clamping mechanism, and more particularly to a power tool having the clamping mechanism for releasably fixing an accessory to a working mandrel.

BACKGROUND

At present, there are various power tools having accessory clamping mechanism on the market. One such power tool has a working mandrel for driving the accessory, the accessory being fixed between a holding portion on one end of the working mandrel facing the tool and a fastening member; and a mechanism for moving the fastening member between a released position in which the fastening member is removed from the working mandrel and a clamped position in which the fastening member is clamped against the holding portion by a spring element. The fastening member has a clamping shaft inserted into the working mandrel. The clamping shaft is held in the clamped position by a locking assembly arranged in the working mandrel and can be removed in the released position. The locking assembly comprises a collar and clamping members, and the clamping members are radially and movably held in a recess portion of the collar and abut against the collar. Each of the clamping members has an inclining surface at one side facing the tool for mating with the inclining surface of the collar so that the movement of the collar abutting against the inclining surfaces of the clamping members can cause an impact on the clamping member towards the center thereof.

The working principle of the power tool lies in that the working mandrel swings around the axis thereof, and the power tool further has a housing, a motor arranged in the housing and a main shaft driven by the motor. The main shaft has a rotating axis and an eccentric portion offset from the rotating axis. A coupling fork is driven by the main shaft and is operatively connected to a working unit. The coupling fork has one end pivotally connected to the working mandrel and the other end formed with a pair of branched forks and coupled on the eccentric portion of the main shaft. The working mandrel is generally perpendicular to the rotating axis of the main shaft, and the rotation of the main shaft around the rotating axis is converted into the pivoting motion of the coupling fork along the working mandrel so as to force the working mandrel to move and drive the accessory to work. If the user installs different accessories to the working mandrel, many different operating functions may be obtained. The common accessory may include a straight saw blade, a circular saw blade, a triangle grinding plate or scraper, etc., thereby performing different operations, such as sawing, cutting, grinding or scraping, etc.

However, as for the accessory clamping mechanism of the above described power tool, in the releasing process, the user needs to remove the clamping shaft and the accessory simultaneously, and similarly in the clamping process, the user needs to clamp the clamping shaft and the accessory to the working mandrel simultaneously, thus this clamping method is seen to be inconvenient to operate. Additionally, once the user loses the clamping shaft incautiously, the accessory clamping mechanism cannot work, and neither can the power tool comprising the accessory clamping mechanism. Moreover, due to the complex structure, the accessory clamping mechanism needs a great number of members and thus the cost is relative high.

Additionally, there is another power tool having an accessory clamping mechanism, which comprises a body with a motor mounted therein; a clamping assembly having a first clamping member which can move between a closed position in which the clamping assembly holds the accessory and an opened position in which the first clamping member of the clamping assembly is deviated from the accessory so as to remove the accessory from the clamping assembly and the first clamping member remains attached to the clamping assembly; and an actuating member having an operating member and movably attached to the body between a first position in which the clamping assembly is in the closed position and a second position in which the movement of the operating member of the actuating member causes the clamping assembly to move to the opened position.

However, when the accessory clamping mechanism is used to clamp an accessory, an end portion of the accessory needs to pass through the working mandrel, thus the end portion of the accessory is provided with an open-ended aperture so as to be clamped and released, but it cannot clamp and release an accessory with an close-ended aperture, and thus the universality of the accessory clamping mechanism is reduced.

SUMMARY

To overcome the defects existing in the prior art, the following describes an accessory clamping mechanism that has a simple structure, does not require an assistant clamping shaft, and which has high universality for accessories.

More particularly, the following describes an accessory clamping mechanism for clamping an accessory to a working mandrel of a power tool, the working mandrel having a mandrel flange and a first longitudinal axis, wherein the accessory clamping mechanism comprises: at least one clamping member; a thrust member for supporting the clamping member; an elastic member by which the thrust member is biased towards a clamped position; a driving assembly for forcing the thrust member and the clamping member to move along a first longitudinal axis, the driving assembly comprising a driving member moved between a first position in which the accessory is in the clamped position and a second position in which the accessory is in a released position, the thrust member and the clamping member being driven by the driving member to move along the first longitudinal axis; and a motion converting member for driving the clamping member to move in a direction different from the first longitudinal axis; wherein in the clamped position, the accessory is clamped between the mandrel flange and the clamping member, and in the released position, the accessory can be removed between the mandrel flange and the clamping member.

Further, the mandrel flange may be provided with a form-fitting structure with the accessory being provided with a corresponding form-fitting structure so that the mandrel flange and the accessory are connected with each other in form-fitting manner, thus a torque may be transmitted without relative rotation between the accessory and the mandrel flange.

Further, the driving assembly may comprise a driving member for rotating around the first longitudinal axis between the first position in which the accessory is in the clamped position and the second position in which the accessory is in the released position. With such operation of the driving member, the user can save effort and facilitate the operation.

Further, the driving assembly may comprise a cam for axially moving along the first longitudinal axis in the moving process of the driving member so that in the clamped position, the cam is disengaged from the thrust member to prevent the thrust member from oscillating with the working mandrel.

Further, the thrust member may have a projection extending in a direction perpendicular to the first longitudinal axis with the thrust member and the motion converting member being arranged in the working mandrel, wherein the elastic member has one end engaged with the working mandrel and the other end engaged with the projection. At least a major portion of the elastic member, at least a major portion of the thrust member and at least a major portion of the motion converting member are accommodated in the working mandrel, which saves space and makes the structure of the power tool more compact.

Further, the working mandrel may have a first guiding portion with the motion converting member having a second guiding portion, wherein the thrust member is slidable along the second guiding portion, and the projection is slidable along the first guiding portion and prevented from rotating around the first longitudinal axis relative to the working mandrel so as to ensure that the thrust member is always movable axially along the first longitudinal axis.

Further, the thrust member may be provided with a guiding portion along which the clamping member is movable in a direction different from the first longitudinal axis so that a surface of the accessory can be clamped by the clamping member and the accessory is clamped between the mandrel flange and the clamping member.

The subject disclosure also describes a power tool having the foregoing accessory clamping mechanism, the power tool comprising: a housing; a motor accommodated in the housing and having a driving shaft; a power source for providing power to the motor; and a transmission mechanism for converting the rotating motion of the motor into the driving motion for the working mandrel. In the power tool, the accessory clamping mechanism can be compactly accommodated in the housing of the power tool so that the accessory is clamped more reliably and the operation is more convenient.

Further, the power tool may be an oscillating power tool, wherein the motor has a second longitudinal axis arranged at an angle relative to the first longitudinal axis, and the transmission mechanism converts the rotating motion of the motor into the oscillating motion of the working mandrel around the axis thereof, wherein the transmission mechanism comprises an eccentric member mounted to the driving shaft and a linkage member having one end connected to the eccentric member and the other end connected to the working mandrel.

The accessory clamping mechanism does not need an additional clamping shaft, thus the clamping structure is simplified. Moreover, it does not need the additional clamping shaft and the accessory to be clamped and released simultaneously, thereby avoiding the risk of losing the clamping shaft for the user and saving the cost; on the other hand, the present invention can clamp the accessory with a close-ended aperture, thereby enhancing the universality of the accessory clamping mechanism.

DETAILED DESCRIPTION

Figure 1:
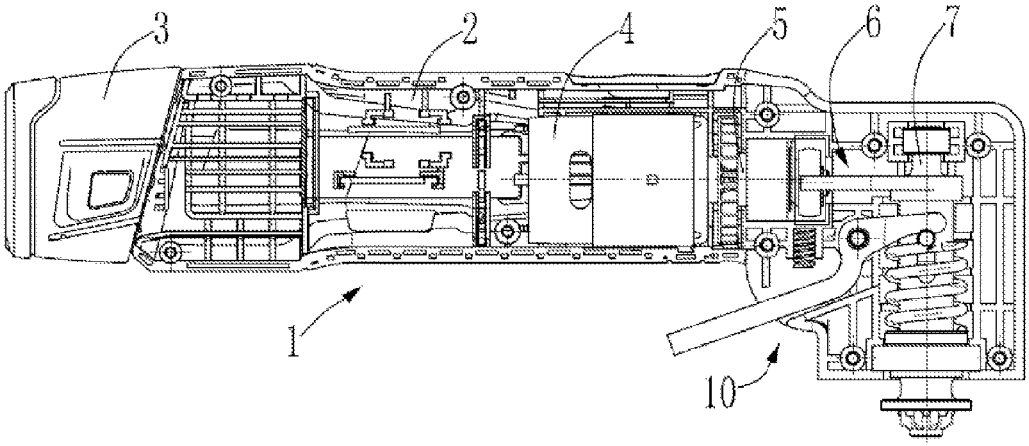
FIG. 1 is a planar schematic view illustrating an exemplary power tool having an exemplary accessory clamping mechanism constructed according to the description which follows, wherein half of the housing is removed.
Figure 2:
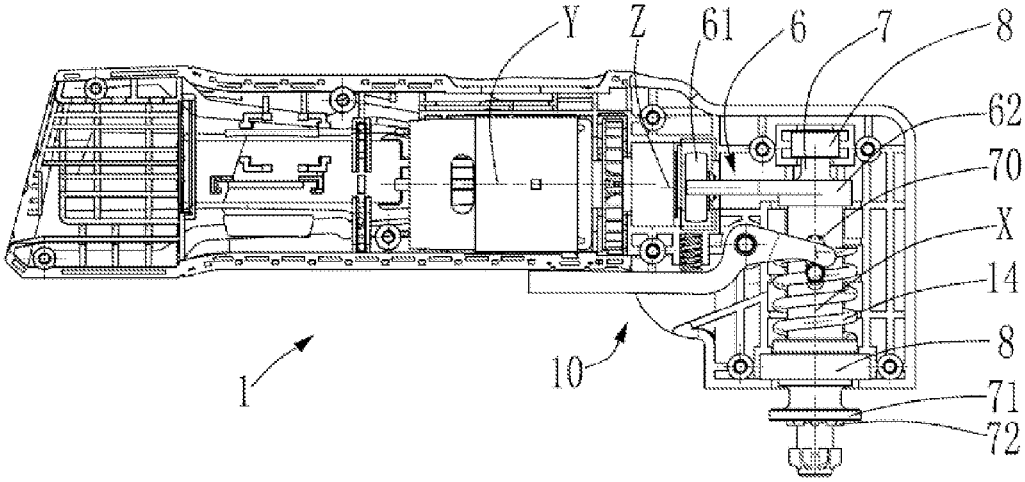
FIG. 2 is a planar schematic view illustrating the accessory clamping mechanism of FIG. 1 in an opened position, wherein the battery pack is removed.

With reference to FIGS. 1-2, a power tool 1 with an accessory clamping mechanism is hereinafter described. An oscillating power tool is taken as an example in this embodiment, but it may be appreciated by the person skilled in the art that the accessory clamping mechanism may also be used in other power tools, such as an angle grinder, a sander or on electric circular saw. The power tool 1 comprises a housing 2, a power source 3 connected to the housing 2, a motor 4 and a driving shaft 5 accommodated in the housing 2, a transmission mechanism 6, a working mandrel 7 and an accessory clamping mechanism 10.

The power source 3 provides power to the motor 4. It may be appreciated that the power source 3 may be any power source well known by the person skilled in the art, such as a battery pack, an AC power unit, an air compressor or a mobile power pack. The driving shaft 5 is driven by the motor 4 and can rotate about its rotating axis Y (the second longitudinal axis). The transmission mechanism 6 comprises an eccentric member 61 and a linkage member 62. The eccentric member 61 has an axis offset from the rotating axis Y of the driving shaft 5, and the linkage member 62 is driven by the driving shaft 5 and operatively connected to the working mandrel 7 which is supported by a pair of bearings 8. The linkage member 62 is configured as a coupling fork. One end of the coupling fork is fixedly connected to the working mandrel 7 and the other end is provided with a pair of branched forks and coupled to the eccentric member 61. The working mandrel 7 has a rotating axis X (the first longitudinal axis) that is substantially perpendicular to the rotating axis Y of the driving shaft 5. It may be appreciated that the rotating axis Y of the driving shaft 5 may be arranged parallel to the rotating axis X of the working mandrel 7 or formed at an angle relative to the rotating axis X. The rotation of the driving shaft 5 around the rotating axis Y is converted into the pivoting motion of the linkage member 62 along the rotating axis X of the working mandrel 7 so as to force the working mandrel 7 to move and drive the accessory 9 to swing. That is to say, the rotation of the motor 4 is converted into the oscillating motion of the working mandrel 7 around its rotating axis X by the transmission mechanism 6.

Figure 3:
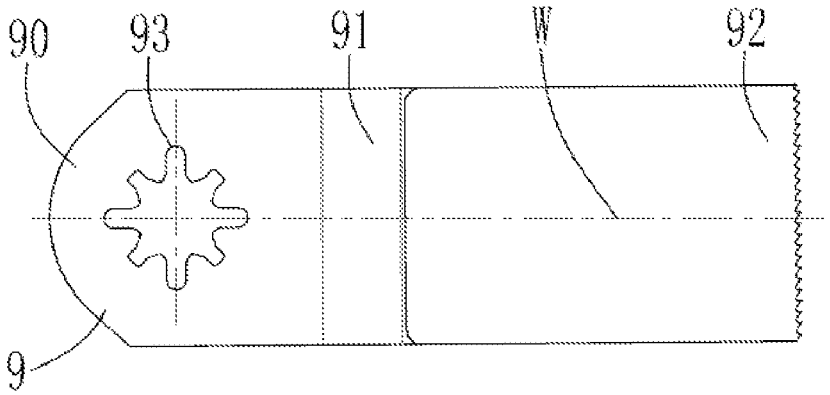
FIG. 3 is a planar schematic view of an exemplary accessory for use with the power tool of FIG. 1.
Figure 4:
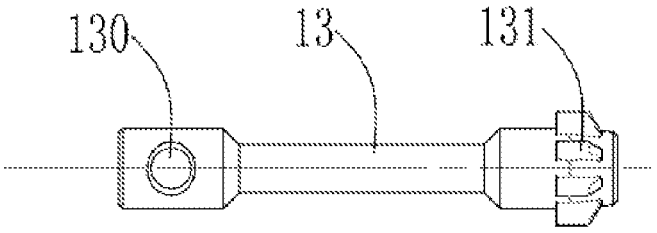
FIG. 4 is a planar schematic view of an exemplary thrust member of the accessory clamping mechanism of FIG. 1.
Figure 5:
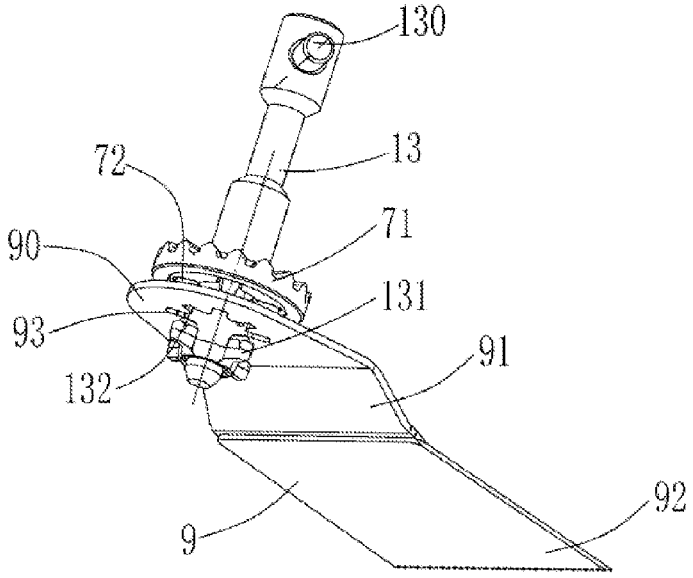
FIG. 5 is a perspective schematic view illustrating the assembly of an exemplary mandrel flange, accessory and fastening flange according to the description which follows.

As shown in FIGS. 2-4, the working mandrel 7 includes a guiding portion 70, a mandrel flange 71 and a form-fitting structure 72. The mandrel flange 71 may be integrated with an end portion of the working mandrel 7, or separated from the end portion of the working mandrel 7. The form-fitting structure 72 is provided with a plurality of bosses extending along the radial direction of the rotating axis X of the working mandrel 7. Preferably, the form-fitting structure is provided with eight bosses. The accessory 9 comprises an end portion 90, a stepped portion 91 and a workpiece processing area 92. The accessory 9 has a longitudinal axis W. The end portion 90 is preferably configured as a close-ended aperture, and the stepped portion 91 has a vertical height. The end portion 90 is provided with a corresponding form-fitting structure 93. Preferably, the form-fitting structure 93 is provided with eight grooves that each can be connected to one of the form-fitting structure 72 of the working mandrel 7 in form-fitting manner. It may be appreciated that the bosses of the mandrel flange 71 and the grooves of the accessory 9 may be arranged as needed, for example, the number of the bosses is four and the number of the grooves is twelve, which is well known to the person skilled in the art. Certainly, the end portion 90 may also be configured as an open-ended aperture, which may also be clamped by the accessory clamping mechanism 10. The accessory clamping mechanism 10 comprises a thrust member 13 having a pin 130 and a fastening flange 131. The pin 130 is engaged with a through hole in one end of the thrust member 13 with interference fit for overcoming the elastic force of the first elastic member 14. It may be appreciated that the thrust member 13 may also be not provided with the pin 130, and the end of the thrust member 13 is used to overcome the elastic force of a first elastic member 14. The fastening flange 131 may be provided with a plurality of projections extending radially. It may be appreciated that the number of the projections may be arranged as needed. The accessory 9 is clamped between the mandrel flange 71 and the fastening flange 131 by the accessory clamping mechanism 10, and the surface of the projection is engaged with the surface of the accessory. It may be appreciated by the person skilled in the art that the accessory may also be clamped by other embodiments. Referring to FIG. 5 for details, the mandrel flange 71 is provided with the form-fitting structure 72 at the side opposite to the accessory. Preferably, the form-fitting structure 72 includes four bosses independent from each other. The form-fitting structure 93 of the accessory 9 preferably includes eight grooves. The thrust member 13 is also provided with a form-fitting structure 132 which preferably includes four projections. Thus, four grooves of the form-fitting structure 93 are connected to the four bosses of the form-fitting structure of the working mandrel in form-fitting manner, and the other four grooves of the form-fitting structure 93 are connected to the four projections of the form-fitting structure 132 of the thrust member in form-fitting manner. After being clamped by the accessory clamping mechanism 10, the accessory 9 is oscillated together with the working mandrel 7. The oscillating frequency may be arranged to be 10000-25000 times per minute and the oscillating angle may be arranged between 0.5° and 7°. With high-frequency oscillating motion, the accessory 9 can perform various operations for the workpiece. The user can perform various different functions by mounting different accessories to the working mandrel 7. The common accessory 9 may include a straight saw blade, a circular saw blade, a triangle grinding plate or a scraper, etc., thereby performing various operations, such as sawing, cutting, grinding or scraping. It may be appreciated that the person skilled in the art may use other functional accessories depending on the actual working situations.

Next, the structure of the accessory clamping mechanism 10 and the specific operating process after combining the accessory clamping mechanism 10 with the power tool 1 will be explained in details.

Figure 6:
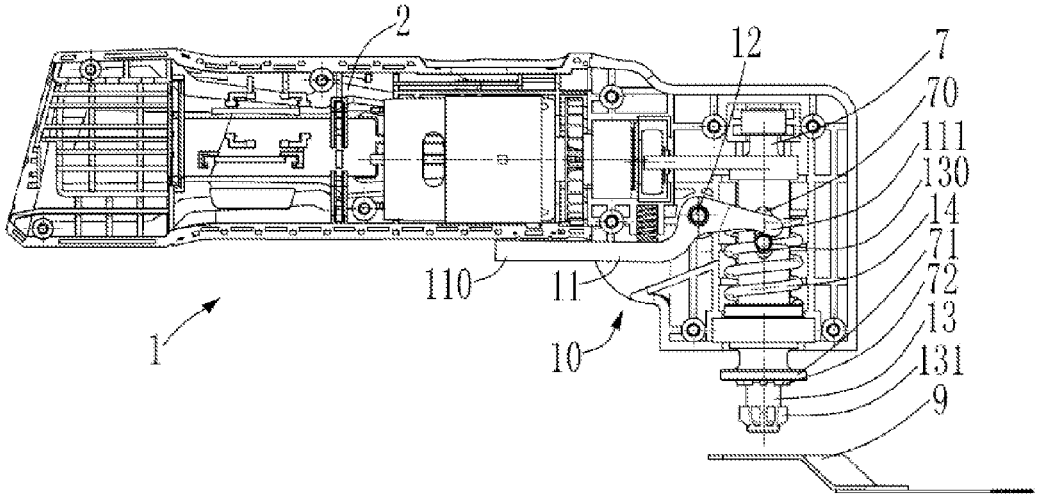
FIG. 6 is a planar schematic view illustrating an exemplary driving member of the accessory clamping mechanism of FIG. 1 in the opened position.
Figure 7:
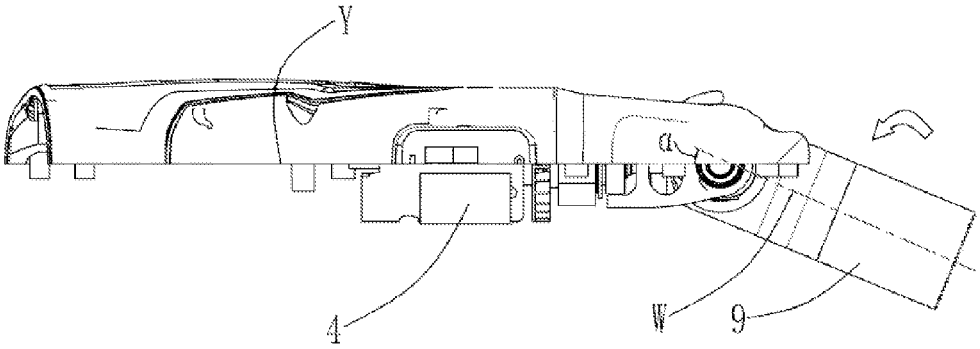
FIG. 7 is a top view illustrating the driving member of the accessory clamping mechanism of FIG. 6 in the opened position.

As shown in FIG. 6, the accessory clamping mechanism 10 comprises a driving assembly, the thrust member 13 and the elastic member 14. The driving assembly comprises a driving member 11 and a pivoting shaft 12 mounted to the housing 2 of the power tool 1. The driving member 11 is pivoted around the pivoting shaft 12 between a first position (a closed position) and a second position (an opened position). In the first position, the fastening flange 131 is in the clamped position, and the accessory 9 is clamped between the mandrel flange 71 and the fastening flange 131; and in the second position, the fastening flange 131 is in the released position, and the accessory 9 may be removed between the mandrel flange 71 and the fastening flange 131. The driving member 11 has a user-operating portion 110 and a driving portion 111 arranged on the opposite sides of the pivoting shaft 12. The user-operating portion 110 is arranged on one end of the driving member 11, and the driving portion 111 is arranged on the other end of the driving member 11. To facilitate the operation, the pivoting shaft 12 is arranged between the user-operating portion 110 and the longitudinal axis X of the working mandrel. In order to perform the operation more easily, the user-operating portion 110 may also be configured as a stretchable or foldable structure. In the working process, the user-operating portion 110 may be stretched or folded, and in the process of releasing the accessory, the user-operating portion 110 is opened so that the user can obtain a larger force thereupon, thus it saves more effort. The driving portion 111 of the driving member 11 overcomes the elastic force of the first elastic member 14 so as to press the thrust member 13 to move axially along the first longitudinal axis X of the working mandrel 7. The elastic member 14 is arranged outside of the working mandrel 7. Preferably, the elastic member 14 may be configured as a compression spring with one end arranged on the mandrel flange 71 and the other end arranged on the pin 130 of the thrust member 13 extending radially. Certainly, the other end of the elastic member 14 may also be arranged on the thrust member 13 directly. It may be appreciated that the first elastic member 14 may also be configured as any other members well known to the person skilled in the art, such as elastic rubber or leaf spring. The fastening flange 131 is biased to the clamped position by the first elastic member 14. The guiding portion 70 of the working mandrel 7 is configured as a groove for guiding the movement of the thrust member 13 so as to ensure that the thrust member is movable axially along the first longitudinal axis X.

Referring to FIGS. 6-11, the process of clamping the accessory is as follows:

As shown in FIG. 6, the user firstly holds the user-operating portion 110 of the driving member 11 so as to overcome the elastic force of the first elastic member 14 to press the driving member to the opened position, wherein the driving portion 111 of the driving member 11 moves in a direction opposite to the user-operating portion 110. The driving portion 111 pushes the thrust member 13 to move axially downwards along the first longitudinal axis X, so that the mandrel flange 71 of the working mandrel is far from the fastening flange 131 of the thrust member 13, and the form-fitting structure 93 of the accessory 9 is aligned with the fastening flange 131. Further referring to FIG. 7, a predetermined angle is formed between the longitudinal axis W of the accessory 9 and the longitudinal axis of the motor 4. The predetermined angle is determined depending on the angle formed by the boss of the mandrel flange 71 and the adjacent projection of the fastening flange 131 in the circumferential direction, thus any suitable angle may be formed depending on the different number of the bosses and the projections.

Figure 8:
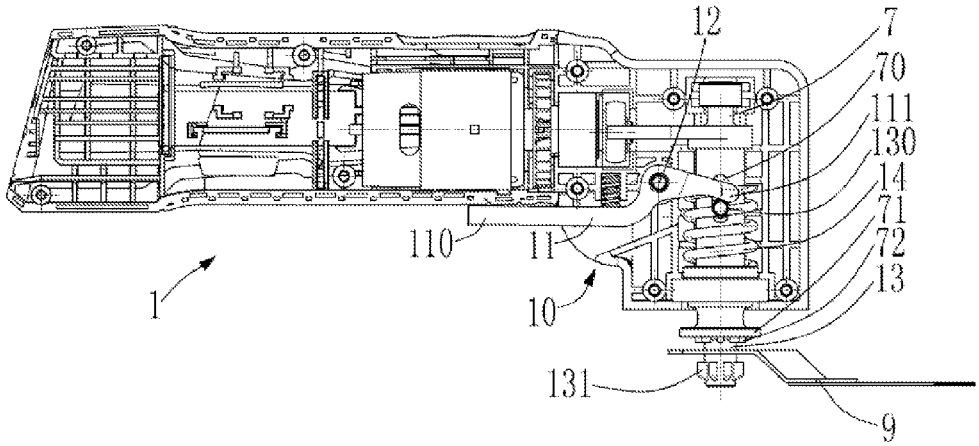
FIG. 8 is a planar schematic view illustrating the accessory of FIG. 6 arranged between the mandrel flange and the fastening flange.
Figure 9:
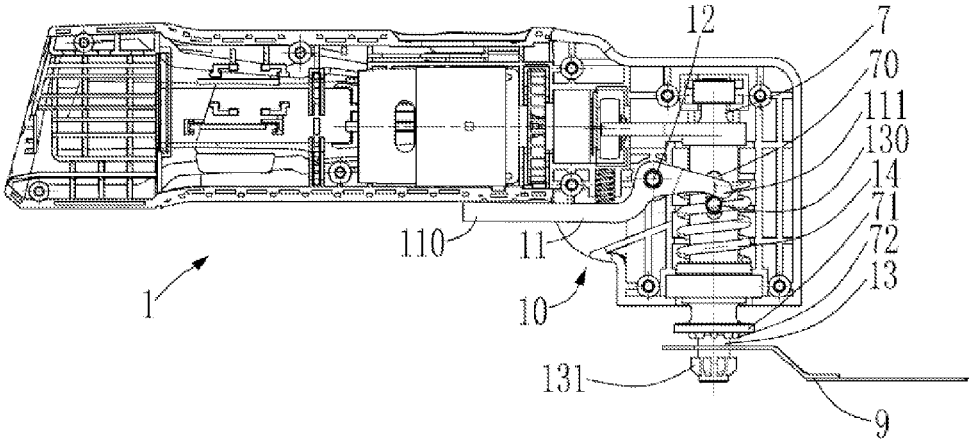
FIG. 9 is a planar schematic view illustrating the accessory of FIG. 6 rotated a predetermined angle.
Figure 10:
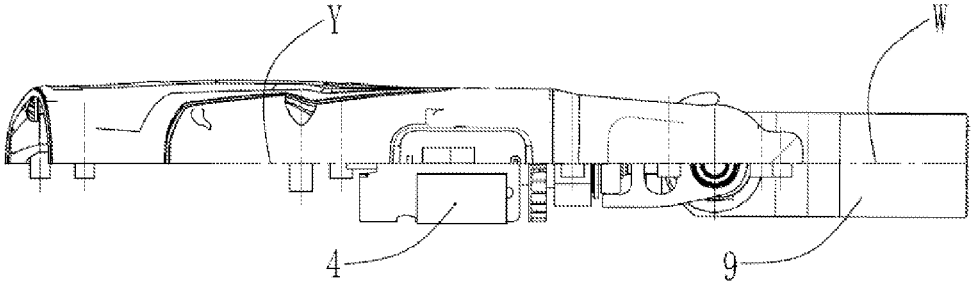
FIG. 10 is a top view illustrating the accessory of FIG. 6 rotated a predetermined angle.
Figure 11:
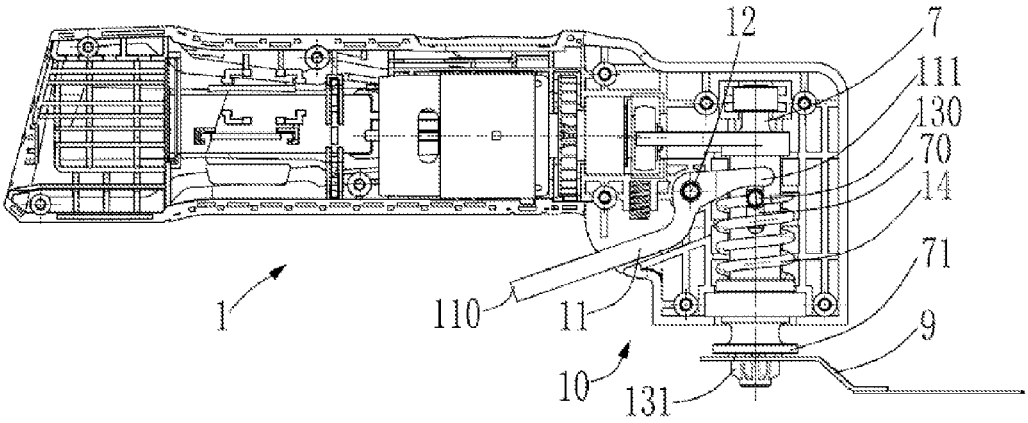
FIG. 11 is a planar schematic view illustrating that the accessory is clamped when the driving member of the accessory clamping mechanism of FIG. 1 is in a closed position.

As shown in FIG. 8, the user holds the driving member 11 in the opened position, and then moves the accessory 9 along the direction of the first longitudinal axis to pass through the projection of the fastening flange 131 of the thrust member 13. At this moment, the position of the groove of the accessory 9 does not correspond to that of the boss of the mandrel flange 71, and the user rotates the accessory 9 along the direction of the arrow indicated in FIG. 7 to the direction as indicated in FIG. 9. Then, the position of the groove of the accessory 9 corresponds to that of the boss of the mandrel flange 71. In order to show the position of the accessory 9 clearly, further referring to FIG. 10, the longitudinal axis W of the accessory 9 is parallel to the longitudinal axis Y of the motor. Certainly, the user may also rotate the accessory 9 to other angles so that the accessory 9 may be operated at different angles. Finally, once the user releases the driving member 11, the driving member 11 is restored to the clamped position under the action of the first elastic member 14, and then the accessory 9 is clamped between the mandrel flange 71 and the fastening flange 131.

In the clamped position, the driving portion 111 of the driving member 11 is disengaged from the thrust member 13 in order to prevent the driving member 11 from moving together with the thrust member 13 in the moving process of the working mandrel 7 of the power tool 1. The driving assembly further comprises a second elastic member 15. The user-operating portion 110 of the driving member 11 is biased towards a direction close to the mandrel flange 71 by the second elastic member 15, and the driving portion 111 of the driving member 11 is biased towards a direction away from the mandrel flange 71 by the second elastic member 15, so that the driving member 11 is disengaged from the thrust member 13 in the clamped position. In the moving process of the working mandrel 7 of the power tool 1, the driving member 11 is always disengaged form the thrust member 13 under the action of the second elastic member, and does not cause a friction between the driving member 11 and the thrust member 13 or even the failure of the driving member because of the movement of the driving portion 111 close to the mandrel flange 71.

The process of releasing the accessory is contrary to the above clamping process.

Figure 12:
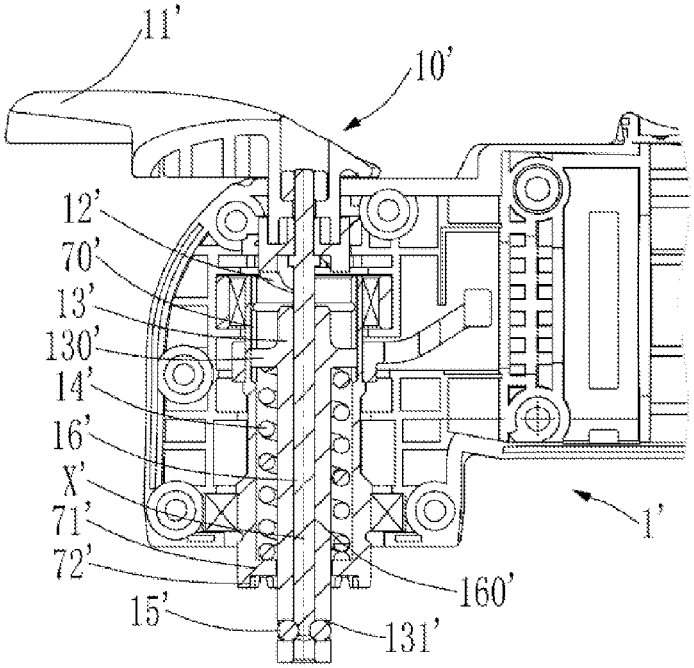
FIG. 12 is a planar schematic view illustrating the driving member of a further accessory clamping mechanism constructed according to the description which follows in the opened position.
Figure 13:
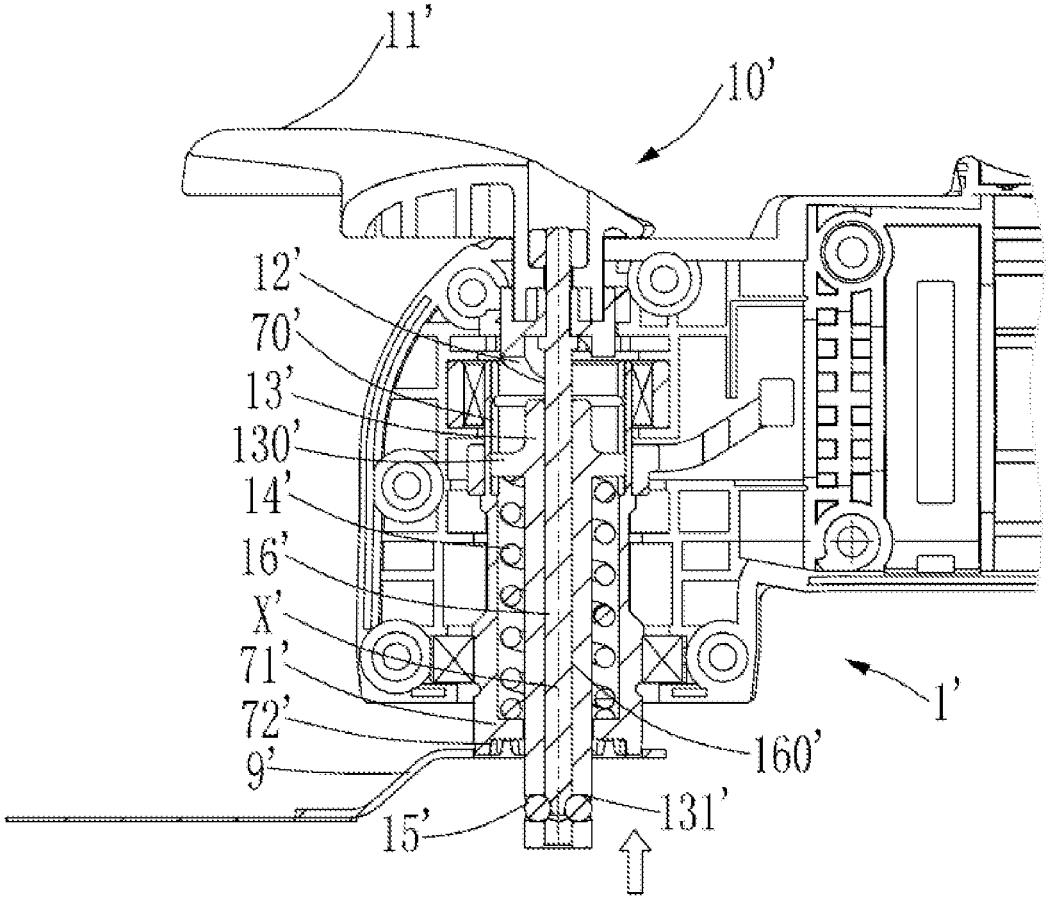
FIG. 13 is a planar schematic view illustrating an exemplary accessory arranged between the mandrel flange and the clamping member of FIG. 12.
Figure 14:
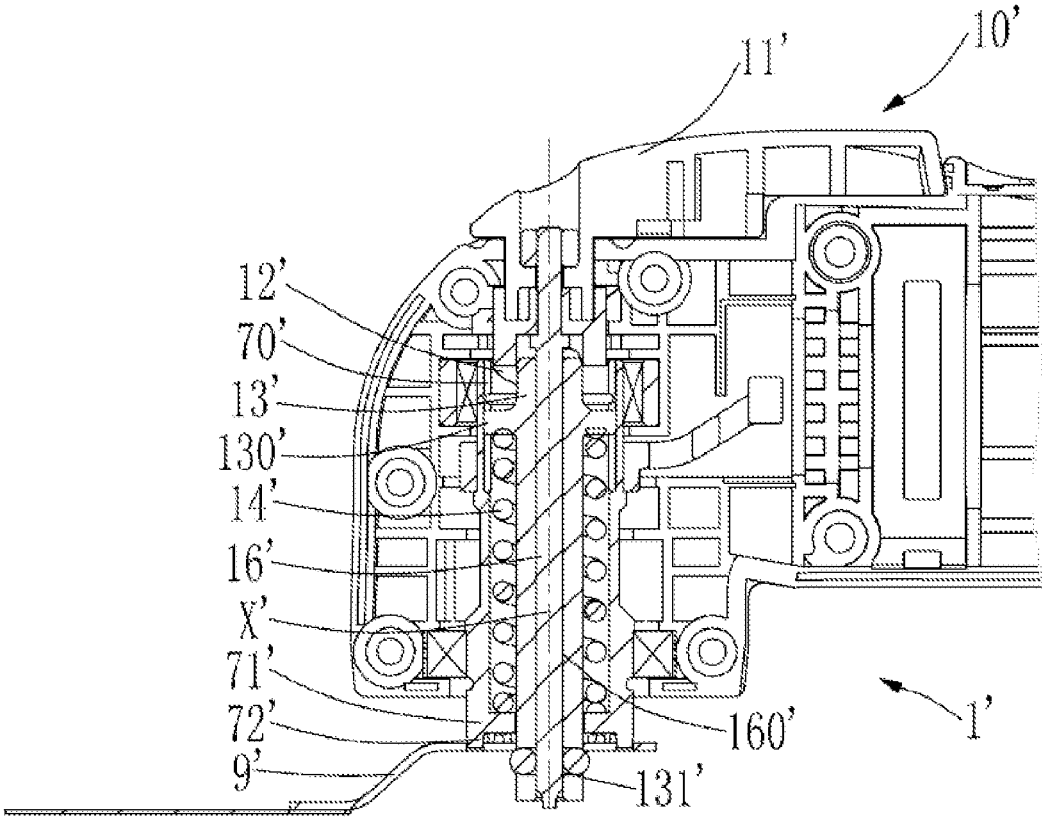
FIG. 14 is a planar schematic view illustrating the driving member of the accessory clamping mechanism of FIG. 12 in the closed position.

FIGS. 12-14 illustrate a power tool 1' comprising an accessory clamping mechanism 10' according to a second exemplary embodiment. The power tool of this embodiment has the same transmission mechanism and working principle as the oscillating power tool of the first described embodiment, thus it is unnecessary to go into details here. Next, the specific structures and operating process of the power tool 1' comprising the accessory clamping mechanism 10' will be explained in detail.

The accessory clamping mechanism 10' comprises a driving assembly, a thrust member 13', a first elastic member 14', at least one clamping member 15' and a motion converting member 16'. The driving assembly comprises a driving member 11' and a cam 12'. The working mandrel 7' comprises a guiding portion 70', a mandrel flange 71' and a form-fitting structure 72'. The working mandrel 7' further has a first longitudinal axis X'. The driving member 11' is rotated around the first longitudinal axis X' between a first position (a closed position) and a second position (an opened position). In the first position, the accessory 9' is in the clamped position and clamped between the mandrel flange 71' and the clamping member 15'. In the second position, the accessory 9' is in the released position, and may be removed between the mandrel flange 71' and the clamping member 15'. In the process of rotating the driving member 11' between the first position and the second position, the user overcomes the acting force of the first elastic member 14' to act on the driving member 11'. Then, the driving member 11' may force the cam 12' to move axially downwards along the first longitudinal axis X' so that the thrust member 13' is also movable axially downwards along the first longitudinal axis X'. It may be appreciated that the driving member 11' may also be arranged to pivot in a direction having an angle relative to the first longitudinal axis X'. For example, the driving member 11' may be pivoted in a direction perpendicular to the first longitudinal axis X'. One end of the thrust member 13' is provided with two projections 130' extending along a direction perpendicular to the first longitudinal axis, and the other end supports at least one clamping member 15'. The working mandrel 7' is provided with a first guiding portion 70'. Preferably, the first guiding portion 70' is configured as two through grooves in which at least part of the projections 130' are accommodated so as to ensure that the thrust member 13' is always movable axially downwards along the first longitudinal axis X' and the rotation of the projections 130' relative to the working mandrel 7' around the first longitudinal axis X' is prevented. One end of the first elastic member 14' is engaged with the projections 130', and the other end is engaged with the inner surface of the mandrel flange 71'. Preferably, the first elastic member 14' is configured as a compression spring. But certainly, as mentioned previously, the first elastic member 14' may also be configured as other members for obtain the biasing, which biases the thrust member 13' towards the clamped position. The motion converting member 16' extends along the first longitudinal axis X', wherein one end is connected to the driving member 11' or the housing 2' of the power tool 1', and the other end is provided with a circular conical surface (not indicated). The motion converting member 16' is further provided with a second guiding portion 160' for mating with the inner surface of the thrust member 13' and guiding the thrust member 13'. The thrust member 13' is further provided with a third guiding portion 131'. Preferably, the third guiding portion 131' is a groove. The at least one clamping member 15' is at least partially accommodated in the third guiding portion 131' and guided by the third guiding portion 131' so that the third guiding portion 131' can prevent the at least one clamping member 15' disengaging from the third guiding portion 131'. Preferably, with the outer end of the third guiding portion 131' being configured as a groove having a diameter smaller than that of the inner end, the groove in the inner end can make the clamping member slide freely, and the groove in the outer end can prevent the clamping member from fully disengaging from the third guiding portion 131'. The motion converting member 16' can convert the axial movement of the at least one clamping member 15' and the thrust member 13' along the first longitudinal axis X' into the movement of the at least one clamping member 15' along a direction different from the direction of the first longitudinal axis X'. Preferably, the at least one clamping member 15' is movable along a direction perpendicular to the first longitudinal axis X'. It may be appreciated that as long as the longitudinal axis of the third guiding portion 131' is arranged to have different angles relative to the first longitudinal axis, such as 60° or 90°, the at least one clamping member 15' is movable at an angle relative to the first longitudinal axis X'. Preferably, the clamping member 15' is configured to include three steel balls. The thrust member 13' is provided with grooves for accommodating the three steel balls respectively, and the circular conical surface of the motion converting member 16' is engaged with the three steel balls. It may be appreciated that the clamping member 15' may also be configured as a sliding block or other members for mating with the surface of the accessory 9', and the number of the clamping member 15' may be arranged differently as needed, for example, two or four. At least a major portion of the thrust member 13', the first elastic member 14' and at least a major portion of the motion converting member are accommodated in the working mandrel 7', while the accessory 9' and the clamping member 15' are arranged outside of the working mandrel 7'.

FIG. 12 illustrates the driving member 11' of the accessory clamping mechanism 10' in the opened position. At this moment, the at least one clamping member 15' is retracted to the groove of the thrust member 13'. Then, the accessory 9' is placed between the clamping member 15' and the mandrel flange 71' along the direction of the arrow indicated in FIG. 13, and the form-fitting structure 93' of the accessory 9' is connected to the form-fitting structure 72' of the working mandrel 7' in form-fitting manner. Subsequently, the driving member 11' is restored to the closed position. At this moment, the thrust member 13' and the clamping member 15' are movable axially upwards along the first longitudinal axis X', and can be restored to the clamped position in which the accessory 9' is clamped between the mandrel flange 71' and the clamping member 15', thus the accessory 9' is clamped reliably.

The process of releasing the accessory is contrary to the clamping process.

The accessory clamping mechanism and the power tool comprising the same disclosed by the present invention are not limited to the contents in the above embodiments and the structures indicated by the drawings. The obvious changes, substitutions and modifications to the shapes and positions of the members based on the present invention are contained in the protection scope of the present invention.

What is claimed is:

1. An accessory clamping mechanism for clamping an accessory to a working mandrel of a power tool, the working mandrel having a mandrel flange and a first longitudinal axis, wherein the accessory clamping mechanism comprises:

at least one clamping member;

a thrust member for supporting the clamping member, the thrust member further comprising a guiding portion, the at least one clamping member being at least partially accommodated in the guiding portion for guiding by the guiding portion;

an elastic member by which the thrust member is biased towards a clamped position;

a driving assembly for forcing the thrust member and the clamping member to move along the first longitudinal axis, the driving assembly comprising a driving member moved between a first position in which the accessory is in the clamped position and a second position in which the accessory is in a released position, the thrust member and the clamping member being driven by the driving member to move along the first longitudinal axis; and a motion converting member for driving the clamping member to move in a direction different from the first longitudinal axis, wherein in the clamped position, the accessory is clamped between the mandrel flange and the clamping member, and in the released position, the accessory can be removed from between the mandrel flange and the clamping member, and wherein the thrust member has a projection extending in a direction perpendicular to the first longitudinal axis, and the thrust member and the motion converting member are arranged in the working mandrel, wherein the elastic member has one end engaged with the working mandrel and an opposite end engaged with the projection.

2. The accessory clamping mechanism according to claim 1, wherein the mandrel flange is provided with a form-fitting structure and the accessory is provided with a corresponding form-fitting structure so that the mandrel flange and the accessory are connected with each other in a form-fit manner.

3. The accessory clamping mechanism according to claim 1, wherein the driving member is rotated around the first longitudinal axis between the first position and the second position.

4. The accessory clamping mechanism according to claim 1, wherein the driving assembly further comprises a cam which is disengaged from the thrust member in the clamped position.

5. The accessory clamping mechanism according to claim 1, wherein the working mandrel has a first guiding portion and the motion converting member has a second guiding portion, wherein the thrust member is slidable along the second guiding portion, and the projection is slidable along the first guiding portion and prevented from rotating around the first longitudinal axis relative to the working mandrel.

6. The accessory clamping mechanism according to claim 1, wherein the thrust member is provided with a guiding portion along which the clamping member is movable in a direction different from the first longitudinal axis.

7. A power tool, comprising:

a housing;

a motor accommodated in the housing and having a driving shaft;

a power source for providing power to the motor;

a working mandrel having a mandrel flange and a first longitudinal axis;

a transmission mechanism for converting the rotating motion of the driving shaft of the motor into the driving motion of the working mandrel; and an accessory clamping mechanism for clamping an accessory to the working mandrel of the power tool, wherein the accessory clamping mechanism comprises:

at least one clamping member;

a thrust member for supporting the clamping member, the thrust member further comprising a guiding portion, the at least one clamping member being at least partially accommodated in the guiding portion for guiding by the guiding portion;

an elastic member by which the thrust member is biased towards a clamped position;

a driving assembly for forcing the thrust member and the clamping member to move along the first longitudinal axis, the driving assembly comprising a driving member moved between a first position in which the accessory is in the clamped position and a second position in which the accessory is in a released position, the thrust member and the clamping member being driven by the driving member to move along the first longitudinal axis; and a motion converting member for driving the clamping member to move in a direction different from the first longitudinal axis, wherein in the clamped position, the accessory is clamped between the mandrel flange and the clamping member, and in the released position, the accessory can be removed from between the mandrel flange and the clamping member, and wherein the thrust member has a projection extending in a direction perpendicular to the first longitudinal axis, and the thrust member and the motion converting member are arranged in the working mandrel, wherein the elastic member has one end engaged with the working mandrel and an opposite end engaged with the projection.

8. The power tool according to claim 7, wherein the motor has a second longitudinal axis arranged at an angle relative to the first longitudinal axis, and the transmission mechanism converts the rotating motion of the motor into the oscillating motion of the working mandrel around the axis thereof, wherein the transmission mechanism comprises an eccentric member mounted to the driving shaft and a linkage member having one end connected to the eccentric member and the other end connected to the working mandrel.

9. The power tool according to claim 7, wherein the driving member is rotated around the first longitudinal axis between the first position and the second position, and the driving assembly further comprises a cam which is disengaged from the thrust member in the clamped position.

* * * * *